US008476993B1

(12) United States Patent
Schilke

(10) Patent No.: US 8,476,993 B1
(45) Date of Patent: Jul. 2, 2013

(54) MOTOR OPERATOR WITH POSITIVE DECOUPLING AND MAXIMUM FORCE APPLICATION FOR ELECTRICAL POWER SWITCHES

(75) Inventor: Aric J. Schilke, North Huntingdon, PA (US)

(73) Assignee: Cleaveland/Price Inc., Trafford, PA (US)

( * ) Notice: Subject to any disclaimer, the term of this patent is extended or adjusted under 35 U.S.C. 154(b) by 0 days.

(21) Appl. No.: 13/433,254

(22) Filed: Mar. 28, 2012

(51) Int. Cl.
*H01H 3/00* (2006.01)
*H01H 9/00* (2006.01)
*H01H 51/00* (2006.01)

(52) U.S. Cl.
USPC ..... 335/68

(58) Field of Classification Search
USPC ..... 335/68–76, 220–229; 218/154; 200/400
See application file for complete search history.

(56) References Cited

U.S. PATENT DOCUMENTS 3,665,348 A * 5/1972 Haydon et al. ..... 335/68
3,980,977 A 9/1976 Evans
4,107,486 A * 8/1978 Evans ..... 200/48 R
4,237,357 A * 12/1980 Opfer ..... 200/400
5,091,616 A 2/1992 Ramos et al.
5,856,642 A 1/1999 Sanders
5,895,987 A 4/1999 Lo et al.
6,025,657 A 2/2000 Lo et al.
6,781,079 B1 * 8/2004 Hillegers ..... 218/154
6,818,846 B2 * 11/2004 Roberts ..... 200/331
6,946,607 B2 * 9/2005 Roberts ..... 200/48 R
7,026,558 B1 4/2006 Andreyo
8,289,681 B2 * 10/2012 Kanaya et al. ..... 361/624

OTHER PUBLICATIONS

Cleaveland/Price Inc., Bulletin DB-128D09 of 2009.
Cleaveland/Price Inc., Bulletin DB-38A09 of 2009.

* cited by examiner

*Primary Examiner* — Bernard Rojas
(74) *Attorney, Agent, or Firm* — R. S. Lombard

(57) ABSTRACT

A switchgear motor operator having its motor shaft coupled to the output member of the operator, that connects with the power switch, through a drive assembly which includes a first drive element continuously linked to the motor shaft, but not to the output member, and a second drive element continuously linked to the output member, but not the motor shaft. Temporary engagement of the mentioned drive elements, with motor operation of the power switch, is effected by a transducer with a movable part such as a solenoid actuated pin that couples the motor of the motor operator to the output shaft. The inherently decoupled state allows manual operation by an operating member, without any turning of the motor or engaging of the temporary force transfer parts during the manual operation. A lockout device with a solenoid deactivation mechanism disconnects the solenoid for motor testing without operation of the power switch.

38 Claims, 7 Drawing Sheets

MOTOR OPERATOR WITH POSITIVE DECOUPLING AND MAXIMUM FORCE APPLICATION FOR ELECTRICAL POWER SWITCHES

BACKGROUND OF THE INVENTION

The invention relates generally to electrical power switchgear with motor operators and, more particularly, to motor operators for power switches with a drive system that facilitates switch operation by force either from the motor of the operator or such as manually applied force, even for switches at overhead (or pole-top) locations.

Motor operators are widely used in combination with power switches. A variety of operators are in use with various features to permit a switch operation to be performed manually. These have included operators with features for mechanically decoupling the operator's drive system from the motor to allow manual operation. Decoupling has taken a number of different forms. Power switches are applied at a variety of locations including some at surface, or ground level, locations relatively easily accessed for manual decoupling and switch operation and some at overhead (or pole-top) locations less easily accessed.

For example, some overhead switches have a motor operator at or near ground level with a mechanical (reciprocating or torsional) link to a switch drive at the overhead location that may be forty or fifty feet higher. Such an operator is, for example, described in Cleaveland/Price Inc., Bulletin DB-128D09 of 2009. Other motor operators are mounted at pole top locations such as on the switch cross arm. Such an operator is, for example described in Cleaveland/Price Inc., Bulletin DB-38A09 of 2009. The motor operator is housed in an enclosure also containing other power, control and protection elements, including elements for initiating operation from a remote control station. To perform a manual switch operation with that system, a worker removes a hand tool (e.g., a hand crank) from the enclosure whose removal opens a handle interlock switch that in turn opens the motor control circuit so the motor will not operate during manual operation. A decoupler pin, or other mechanical release element, is available for manual removal so a manual switch operation can be performed using the hand tool to apply force to move the mechanical linkage to the overhead switch without requiring manual turning of the motor. When manual operations are completed, replacement of the hand tool and the decoupler pin restores the system for operation by the motor.

Such systems have been quite successful. Recently, however, some interest has developed in equipping overhead switches with motor operators at the pole-top location with only a short mechanical link to the switch. This can, for example, lessen any concerns about dimensional variance of the mechanical linkage over the long life of an installation, minimize ground equipment subject to safety or vandalism concerns, and provide an overall cleaner, uncluttered look to an installation (even though some power supply and control elements can be housed at a surface location, preferably of course well secured in a locked enclosure). While such operators may be similar to the former ground-based units in some respects, e.g., including remotely initiated power operation, if the same features for manual operation are retained there is the problem of accessing the manual elements, such as requiring a worker to climb up to the operator, or use of a lift-truck, which is expensive and troublesome. Among other prior art of switch motor operators with some kind of decoupling for manual operation, whether or not for overhead installations, are those contained in the following U.S. patents (which are merely partially and briefly described).

Evans U.S. Pat. No. 3,980,977, Sep. 14, 1976, illustrates a system in which insertion of a specified hand tool at a particular location of a clutch mechanism in a motor operator disconnects the motor from the mechanism and allows manual rotation of a drive lever that recharges a wound spring operating mechanism.

Ramos et al. U.S. Pat. No. 5,091,616, Feb. 25, 1992, shows a pole-top motor operator and specially designed switch combination with a disconnect linkage manually operable by a hook stick or the like that moves switch-pole housings of the switch.

Sanders U.S. Pat. No. 5,856,642, Jan. 5, 1999, discloses an infinite engagement friction clutch coupled switch operator with selectable engagement and disengagement by a user to allow for manual operation.

Lo et al. U.S. Pat. No. 5,895,987, Apr. 20, 1999, and U.S. Pat. No. 6,025,657, Feb. 15, 2000, presents a switchgear motor operator with a drive including a clutch with a hub and friction discs or an actuator-follower arrangement with opposing actuating and follower surfaces that is subject to an automated control means that responds to a switch operation to reverse the engaging elements to allow manual operation.

Such known art, however useful each may be and with whatever varied tradeoffs each carries with it in terms of high or low cost, convenience, complexity, and susceptibility to inoperability due to a loss of power or functionality, all has a common characteristic in that each necessitates performing an explicit decoupling process, in addition to the merely normal switch opening and closing of a motor operator, either manually or motor driven and either specifically initiated when desired or automatically by a control system.

U.S. Pat. No. 7,026,558 issued Apr. 11, 2006, to Joseph K Andreyo, and assigned to the present assignee, which patent is herein incorporated by reference as though fully set forth, discloses a switchgear motor operator having its motor shaft coupled to the output member of the operator, that connects with the power switch, through a drive assembly with at least one drive element continuously linked to the motor shaft, but not to the output member, and at least another drive element continuously linked to the output member, but not the motor shaft. Temporary engagement of the mentioned drive elements, with motor operation of the power switch, is effected by temporary force transfer parts on the drive elements (e.g., a fixed post on one engaging a spring-loaded cam bar on the other) which inherently disengage following force transfer sufficient to operate the switch. The inherently decoupled state allows immediate straightforward manual operation by an operating member, even when the motor operator is at an overhead switch location, without any turning of the motor or engaging of the temporary force transfer parts during the manual operation. However, it has been found that that the temporary engagement of the aforesaid temporary force transfer parts, i.e., a fixed post on one engaging a spring-loaded cam bar on the other may result in less than the maximum force of the motor being applied to the power switch or less than the force required for ice breaking when ice accumulates on the overhead switch. Reference is made to the aforesaid Cleaveland/Price Inc., Bulletin DB-38A09 of 2009.

Proceeding from this known prior art, it can be regarded as an object of the present invention to provide a motor operator with positive decoupling characteristics for such electrical power switches, but also operates with higher force for ice breaking and operating switches that require such high force.

SUMMARY OF THE INVENTION

The present invention provides a switchgear motor operator having its motor shaft coupled to the output member of the operator, that connects with the power switch, through a drive assembly which includes a first drive element continuously linked to the motor shaft, but not to the output member, and a second drive element continuously linked to the output member, but not the motor shaft. Temporary engagement of the mentioned drive elements, with motor operation of the power switch, is effected by a transducer with a movable part such as a solenoid actuated pin that couples the motor of the motor operator to the output shaft connected to the electrical power switch via a plate coupled to the output shaft. The transducer is attached to and rides on the movable first drive element. Only when the motor and solenoid are simultaneously energized is the motor coupled to the output shaft. At the end of the travel, the motor is dynamically braked for a quick stop and the solenoid is de-energized to disconnect the motor automatically from the output shaft. Since the motor is not normally connected to the output shaft, a manual operation of the electrical power switch can be accomplished without the drag of the motor. The invention provides positive decoupling of the motor and solenoid from the electrical power switch when de-energized, but upon energization of the motor and solenoid complete positive connection via the solenoid pin to obtain maximum force output of the motor. The high force output of the present invention helps to break ice that forms on such outdoor electrical power switches and helps to operate switches that require higher force. A positive acting lockout apparatus with a solenoid deactivation mechanism is also disclosed which allows testing of the motor without operating the overhead switch.

Manual operation is easy to perform with the decoupled operator.

The inherent decoupling of the motor drive can facilitate performance of a manual operation, even with a pole-top motor operator and switch installation. A worker does not need to perform a positive act to achieve decoupling and does not need to rely on operation of a control system (that might be inoperable due to loss of power) to achieve the decoupled state. In normal use, there is no need for a worker to be immediately at the operator during a remote operation. Manual operation of an overhead switch from the ground is readily performed using a hookstick to pull on the operating member.

The operating member is all that is required to be used for a manual operation. Typically, such as in the case of an overhead or pole-top installation, a worker applies a hookstick or the like to that operating member (e.g., a handle with one or more features such as loops or apertures to capture the hookstick) to perform a manual switch operation with the already decoupled operator.

Also, the decoupled state allows a worker to operate (e.g., for testing) the motor without operating the switch itself by locking the operating member, such as by inserting a locking pin into a locking hole in the operating member to secure the operating member to a fixed part of the housing or support structure. The locking pin also actuates a microswitch to take the solenoid out of the circuit to maintain the decoupled state while testing the motor.

The lack of complexity of the required structure enhances its reliability and convenience in use. In some forms, after the switch travels to the open or closed position, the operating member of the motor operator hits its end-of-travel stops (e.g., stop posts fixed to the housing or support structure) to limit the travel for a manual operation. Further, a simple limit switch at each of the open and closed positions on one of the drive elements can be triggered by the other drive element to turn off power to the motor at the end of the desired travel of the overhead switch.

In a typical application with preferred features, a worker at ground level can interact with the motor operator system in two ways. A control switch panel at ground level can be (and preferably is) first switched from "Remote" to "Local" operation (switch setting to prevent any remote power operation (as might occur following an outage)). Then the worker uses a hookstick (or "hot stick") to operate the lever or whatever other operating member is provided. Then "Local" operation of the motor (in the coupled or the decoupled state) can be performed as desired with controls switched to "Remote" as a further option.

While exhibiting characteristics particularly addressing the problem of difficult access described in the Background in connection with overhead switches, the apparatus of the invention also is generally applicable in combination with power switches in any location. Also, the power switches with which the operator of the invention is used may be those commonly available without requiring special switch features for getting the benefits of the invention.

These and other aspects of the present invention will be better understood from the following discussion and drawings of example embodiments.

DETAILED DESCRIPTION OF VARIOUS EMBODIMENTS

Figure 1:
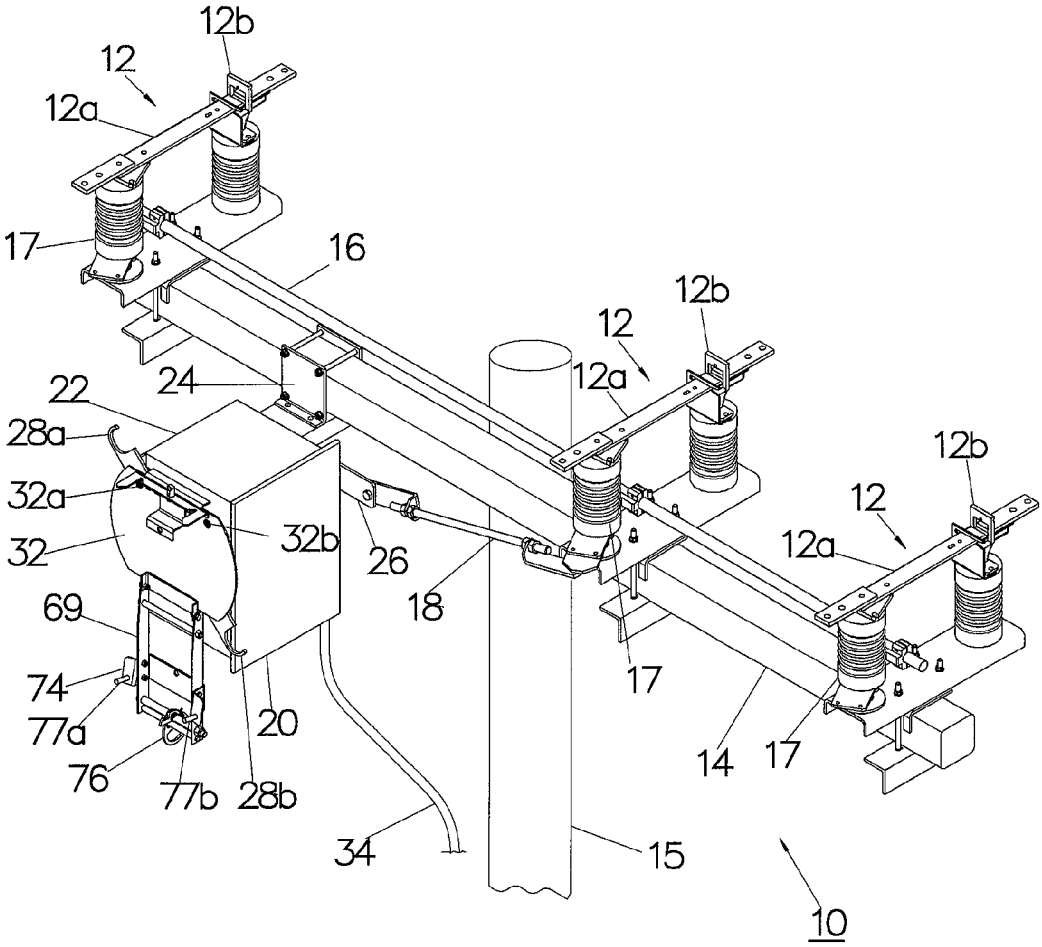
FIG. 1 is a perspective, partial view of an overhead (pole-top) switch and motor operator installation with the switch shown closed.
Figure 2:
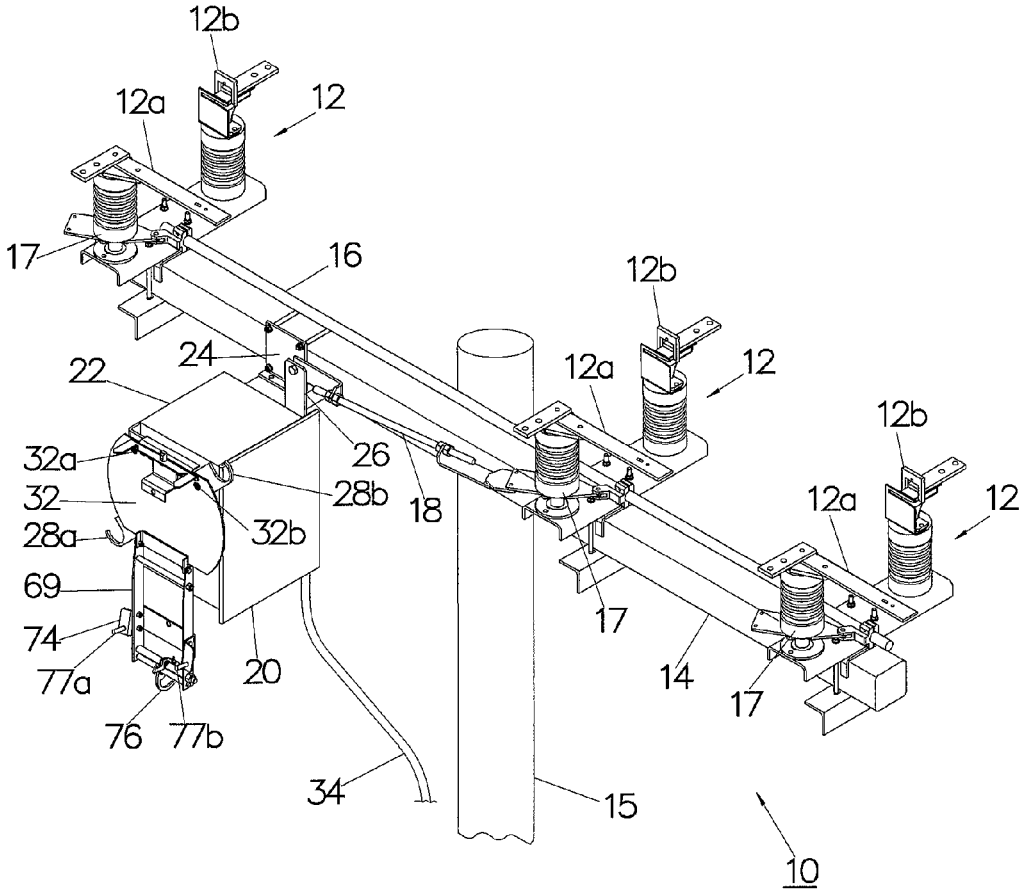
FIG. 2. is the same view as FIG. 1 with the pole top switch shown open.

FIG. 1 shows a typical pole-top installation of an electrical power switch 10 and a motor operator 20 in accordance with the invention. The illustrated switch 10 is a three-phase distribution switch with three switch poles 12 arranged for ganged operation on a cross-arm 14 on a utility pole 15. Each of the switch poles 12 includes a first switch contact 12*a* that is movable to a closed or open switch position in relation to a second switch contact 12*b* that is fixed. The three movable contacts 12*a* are each mechanically coupled to a switch operating rod 16 for operation together. The rod 16 is subject to linear movement effecting switch operation by rotation of one switch-pole movable insulator post 17 that has a mechanical linkage 18 to an output member of the motor operator 20. The illustrated switch 10 is sometimes referred to as a movable insulator type of switch because of the force transmitted through rotating insulators that support the movable contacts 12*a*. In the orientation shown in FIG. 1, the switch contacts 12*a* and 12*b* are closed. FIG. 2 shows the same switch, but the movable contact 12*a* is open and not in contact with 12*b*.

The switch 10 may be of a known type of three-phase distribution switch. It could generally be any motor operable switchgear, including distribution switches, transmission switches, reclosers, and the like.

Figure 3:
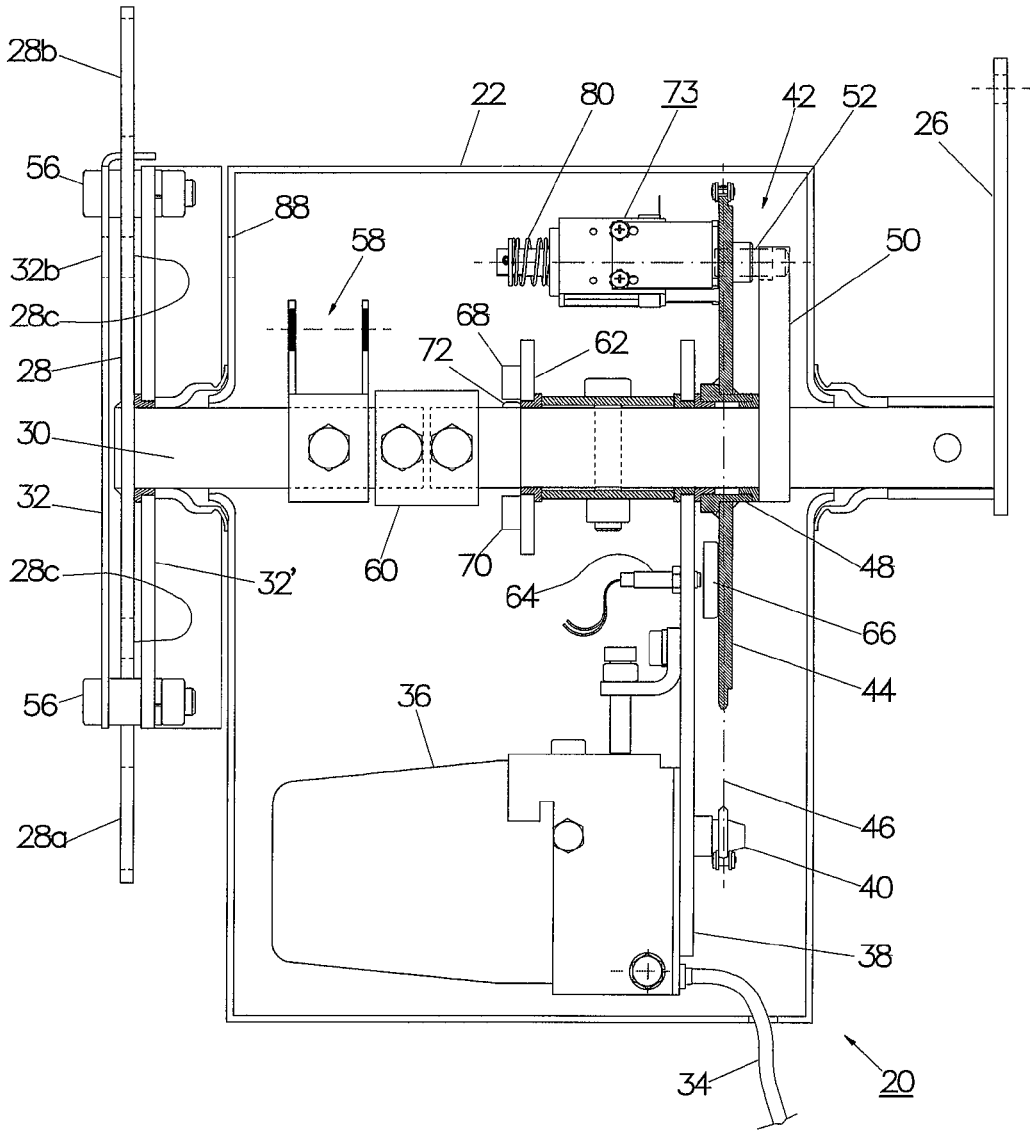
FIG. 3 is a side elevation view of a motor operator in accordance with one embodiment of the invention with one side panel of the operator removed from the operator housing without the lockout device shown in FIG. 2.

With reference to FIGS. 2 and 3 the motor operator 20 is shown having a housing 22 supported on the switch cross-arm 14 by a bracket 24. Extending from the back of the housing 22 there is an output member or lever 26 that is attached to the mechanical linkage 18 of the switch 10. At the front of the housing 22 there is shown an operating member or handle 28 that is accessible for manual operation. As will be discussed further below, the output member 26 and the operating member 28 are continuously mechanically linked to each other, and subject to mutual rotational motion, by an operator shaft 30 extending through the interior of the housing 22. An exterior plate 32 is fixed to the front of the housing 22 and has features that play a role (particularly in limiting rotational motion of the operating member) as further discussed below. FIG. 2 also shows by way of example a conduit 34 for electrical conductors connected with elements within the housing 22, such as for supply of power to a motor and to a transducer. Conduit 34 communicates to an electrical supply and control unit (not shown) that includes, for example, indicators of power switch status and motor position status that a worker can view and control switches that a worker can selectively alter for remotely or locally initiated power operation of the motor operator or manual operation. FIG. 1 also shows a manual operated locking device 74 which is described in more detail subsequently.

FIG. 3 shows internal elements of the motor operator 20. Compared to FIG. 2, FIG. 3 is substantially as if the right side of the housing 22 is removed together with the locking device 74. A motor 36 is supported on a mounting plate 38 joined with a wall of the housing 22. The motor 36 has a motor shaft 40 that rotates under power to the motor from the electrical conduit 34. A mechanical drive assembly 42 is coupled between the motor shaft 40 and the operator output member 26. The motor 36 is, for example, a reversible AC/DC motor.

In this example, the mechanical drive assembly 42 includes, without exclusion of other possible elements, a first drive plate 44 mechanically linked to the motor shaft 40. The first drive plate 44 and the motor shaft 40 each have sprockets on which a chain 46 runs. The first drive plate 44 is an example of a first drive element that is continuously mechanically linked to, and subject to movement with, the motor shaft 40. Rotation of the first drive plate 44 occurs about, but not joined with, the operator shaft 30. One or more bearings 48 between the plate 44 and the shaft 30 allow free relative motion of the two elements.

The mechanical drive assembly 42 of this example also includes a second drive plate 50 that is connected to and subject to rotation with the operator shaft 30 (and, consequently, the output member 26 and the operating member 28). The second drive plate 50 is, in this example, one that extends radially from the shaft 30 without completely encircling the shaft (although complete encirclement of the shaft is possible). The second drive plate 50 is an example of a second drive element that is continuously mechanically linked to, and subject to movement with, the operator shaft 30.

Mechanical linkage between the first drive plate 44 and the second drive plate 50 occurs, during operation of the motor 36, but only temporarily. That is, for switch operation, it occurs for a sufficient time, and with a sufficient engagement, for the switch 10 to be operated by reason of rotation of the lever 26, but then engagement ceases. This is because the two drive plates 44 and 50 are temporarily locked together as shown, in FIGS. 3 and 11, by spring-loaded solenoid pin 52 of solenoid assembly 73 (transducer with movable part) which is fixed on movable first drive plate 44 and pin 52 engages plate 50 to cause rotation of plate 50. With reference to FIGS. 6-11, in general, the engagement of pin 52 with plate 50 at slot 53 (opening) is such as to transmit torque for operation of the switch 10 and then disengage (become decoupled) without any manual decoupling operation or need for reversal of the motor drive to reverse and decouple the parts 52 and 50 upon de-energization of the solenoid assembly. It is also possible without departing from the invention that the opening, i.e., slot 53 may instead be a catch element (not shown) which may include a cam surface. The catch element is attached to the periphery of plate 50 at a location of slot 53, for example. The catch element may be of a footprint that approximates the perimeter of the slot 53 with wall portions of sufficient height to fully engage the pin 52 when activated. The catch element may include a cam surface (on the wall portions) that allows for smooth capture of pin 52.

Other elements shown in FIG. 3 include a second fixed plate 32' outside the housing 22 and joined with the first plate 32 in a parallel relation by stop bolts 56 that limit the travel of the operating member 28.

A shaft biasing mechanism 58 (e.g., of the springloaded or weighted overcenter type) is generally illustrated on the shaft 30 near the front (left face) of the housing 22. The mechanism 58 (not detailed in the drawing) can include a member fixed on the shaft 30 that works against a spring fastened between that member and a wall of the housing 22. The arrangement is such that rotation of the shaft 30 in either direction has to overcome some spring force and loose or floppy movement of the shaft mounted elements 26 and 28 is avoided.

For convenience in assembly, the shaft 30 may be in two colinear pieces with a fixed coupling 60.

In the example of FIG. 3, the shaft 30 is principally supported by a bearing and support structure 62 secured to the housing 22.

Also, FIG. 3 shows that the motor mounting plate 38 has a position sensor or limit switch 64 with electrical conductors that are not fully shown but are carried through the electrical conduit 34 along with the leads to the motor 36. The position sensor 64 is such that it responds with an electrical signal when rotation of the first drive plate 44 places a magnet 66 immediately proximate the position sensor. The electrical signal is carried to a ground level control panel to indicate the positional status of the drive assembly 42. In FIG. 3, for a closed switch 10 position as shown in FIG. 2, the elements 64 and 66 are immediately adjacent to each other and power to the motor 36 would be off. A second limit switch (not shown) is on a more remote part of the plate 38 for responding to the magnet 66 in the open switch position of the drive.

The elements 64 and 66 (and the unshown counterpart) result in a signal that turns off power to the motor 36 and to solenoid assembly 73 and also serves to indicate that the motor has turned the drive plate 44 clockwise or counterclockwise to the proper angular position. In addition, the operator 20 has microswitches 68 and 70 on a fixed part of the operator 20 that generate a signal when a knob 72 on the shaft 30 forces contacts of either switch 68 or 70 to close. The signals from either switch 68 or 70 indicate the open or closed rotational status of the output member 26 and, therefore, of the power switch 10. Leads for switches 68 and 70 (not shown) would also be carried by the electrical conduit 34.

Figure 4:
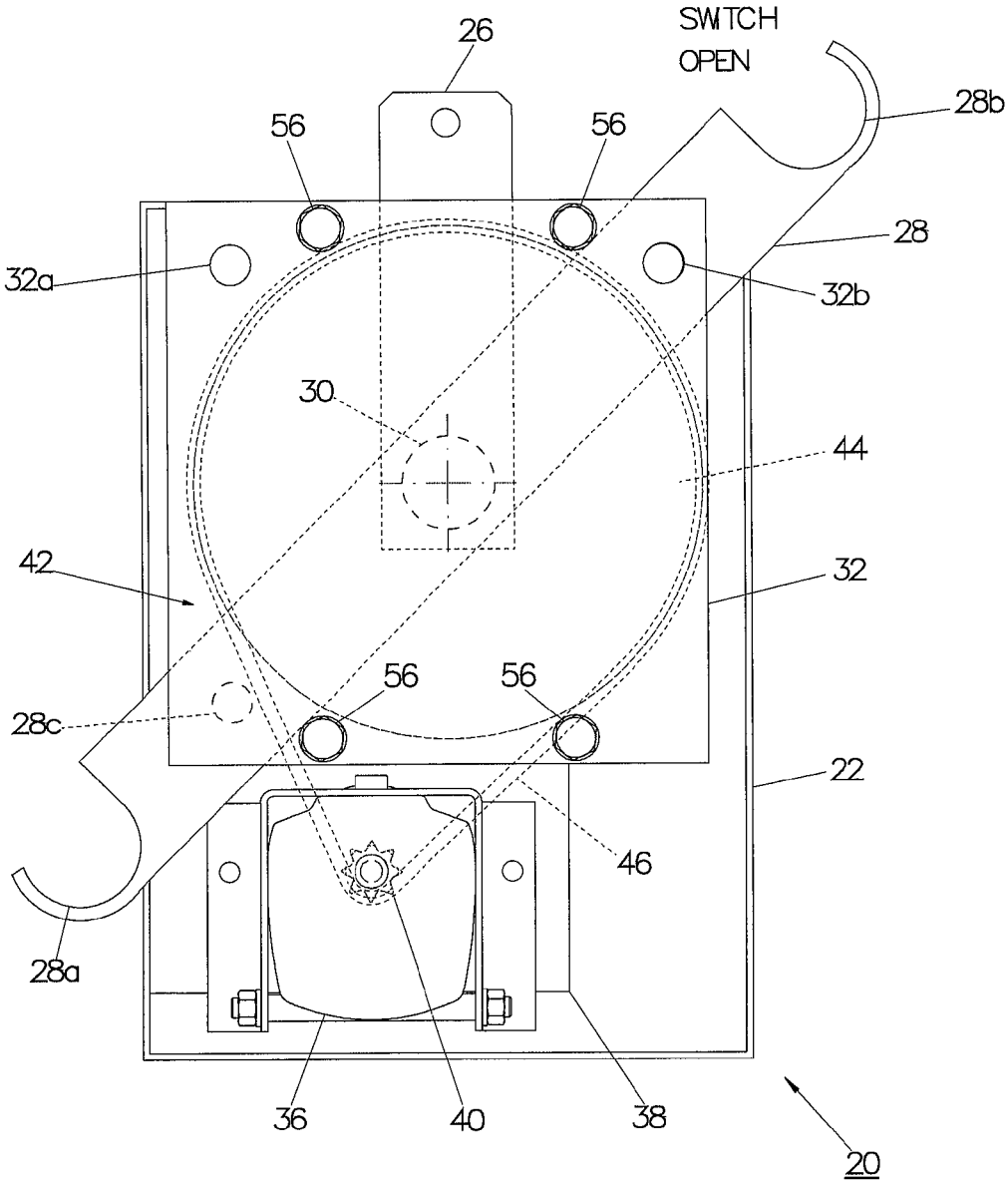
FIG. 4 is a front elevation view of the motor operator of FIG. 3 with some simplification of elements.

Further explanation of the structure and operation of the motor operator 20 will be given in connection with FIGS. 3 through 9. FIG. 4 is a front elevation view of the operator 20 of FIG. 3 with some simplification for easier discussion; the front of the housing 22 is assumed to be transparent and only a few of the elements behind the front plate 32 or the motor mounting plate 38 are shown (in dashed lines).

The mechanical drive assembly 42 is partly shown in FIG. 3 with the first drive plate 44 driven by the chain 46 off a sprocket on the motor shaft 40. Under motor operation, as previously explained (FIG. 3), the drive plates 44 and 50 transmit torque to the output member 26 by the brief engagement of the pin 52 with the plate 50. The illustrative example of FIGS. 3 and 4 represents an operator 20 for an airbreak switch 10 (FIG. 2) of which those in wide use most commonly operate between open and closed positions that are 90° apart as shown in FIGS. 1 and 2. That means the operator output member 26 and the mechanical linkage 18 to the switch 10 can also be conveniently arranged for 90° rotation. This also means that 90° rotation of the operator shaft 30 produces the 90° rotation of the output lever 26 and necessarily also produces 90° rotation of the operating member 28. The principles of the operator 20 can, of course, be applied to operators for switches which require some angle of rotation of the output shaft different than 90°.

In this example operator 20, it is restriction of motion of the operating member 28 that determines the extent of the motion of the output lever 26. The handle 28 turns on the operator shaft 30 in substantially parallel relation to the fixed plates 32 and 32' (FIG. 3) that are joined by the stop bolts 56, four of which are shown in FIG. 4 at orthogonal locations on the plate 32. In FIGS. 3 and 4, the position of the handle 28 represents a switch open position as in FIG. 2. The handle 28 has been turned counterclockwise until it has been stopped by the upper right and the lower left stop bolts 56. At that point the drive assembly 42 cannot turn the shaft 30 or the lever 26 any further. The torque applied by the motor 36 is transferred to first drive plate 44 when spring-loaded pin 52 engages with the second drive plate 50 (pin moves for engagement with second drive plate 50). When pin 52 is not engaged with the drive plate 50, the result is the inherent decoupling of the motor 36 from the lever 26. Pin 52 is actuated in and out of drive plate 50 when the solenoid assembly 73 is energized or de-energized by the same electric current that energizes motor 36. Therefore, when the motor is not energized, the solenoid is not actuating the pin 52 to couple first drive plate 44 to second drive plate 50. Only when the motor and solenoid are energized together is the coupling made between plate 44 and plate 50 and then the output lever 26 operates the switch 10. Plate 50 is provided with a slot 53 for receiving pin 52 when the solenoid is energized and pin 52 is moved into alignment with slot 53 by the rotation of plate 44 to which solenoid assembly 73 is attached. When the solenoid is de-energized, the spring 80 returns pin 52 to the uncoupled position. The solenoid assembly 73, for example, may be one manufactured by Guardian Electric, model no. 4HD-I-110 volts D.C. having the following characteristics of 130 ounces force at 0.12 inch. In the decoupled state, manual operation of the switch 10 is achieved by operating handle 28. Of course it should be mentioned as an alternative arrangement it is possible that the solenoid assembly 73 could be mounted on second drive plate 50 and a corresponding slot 53 be provided in first drive plate 44 without departing from the invention.

Figure 5:
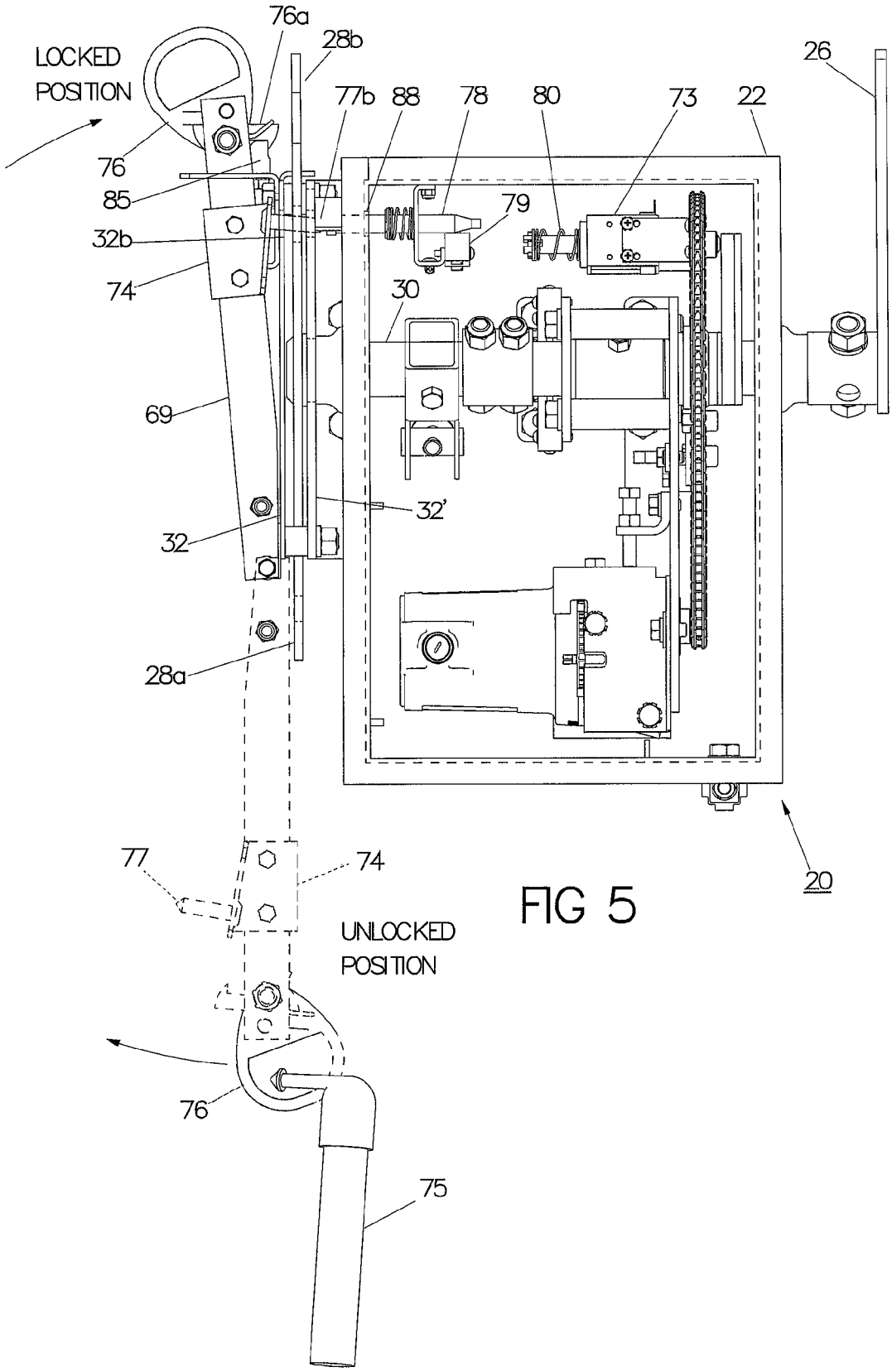
FIG. 5 is a side elevation view as in FIG. 3 but also showing the lockout device.

The decoupled motor operator 20 is now readily available for a manual operation, and the manual operation does not require any turning of the motor 36 or any engagement of pin 52 with drive plate 50. In the embodiment shown, the handle 28 has portions extending beyond the plate 32. Each of these extended portions of the handle 28 has a feature, such as the open loop type features 28*a* and 28*b* that can readily accept and retain a hookstick 75 (as shown in FIG. 5) or the like for a manual operation. To go from a switch open position as is taken as the example of FIGS. 2-4 (although the converse could also be the case) to a switch closed position, a worker places a hookstick in the upper right handle loop 28*b* and turns it 90° clockwise where the handle 28 stops against the lower right and upper left stop bolts 56. After a manual switch closing, a corresponding manual switch opening can be performed with a hookstick in the left handle loop 28*a* and the handle 28 would be moved counterclockwise until stopped by the lower left and upper right stop bolts 56.

The geometry of the handle 28 can of course be varied from that shown. For example, it can be provided with hook retaining apertures rather than the open loops 28*a* and 28*b*. The open loops 28*a* and 28*b* contribute to worker safety. For example, if a worker has a hookstick in the handle loop 28*b* in the position shown in FIG. 4 and somehow the motor 36 is energized, the clockwise movement of the handle 28 by the motor will separate the handle 28 from the hookstick because of the open loop without having force transmitted through the hookstick to the worker if the loop was a closed loop.

FIGS. 2 and 5 also illustrate an option that can be another significant feature of the operator 20. When a worker has an interest in testing the motor 36 without turning the output lever 26 that operates the switch 10, it is convenient to lock the handle 28 in a fixed position so that the switch 10 is either opened or closed. Handle 28 has locking holes 28*c*. A manually operated locking device 74 is provided as shown in FIGS. 2 and 5 which mechanically prevents handle 28 from rotating during motor testing or as required for safety to lock the switch open or closed. The locking device 74 includes a manually movable frame assembly 69 pivotably mounted at one end to exterior plate 32. Attached to the frame assembly 69 are two oppositely disposed contact and locking pins 77*a* and 77*b* as shown in FIG. 2. To operate the locking device 74 as shown in FIG. 5 hookstick 75 is engaged in the eyelet 76 and eyelet 76 is raised up until latch 76*a* engages with anchor 85 to lock the locking device 74 to a locked position from the unlocked position. This causes pin 77*b* which passes through aperture 88 in housing 22 to move the spring loaded pin 78 to cause electrical operation of microswitch 79 which takes the solenoid 73 out of the circuit and prevents pin 52 from engaging with drive plate 50 while simultaneously preventing the handle 28 from rotating by the pin 77 engaging locking holes 32*a*, or 32*b* with 28*c* depending on the position of handle 28. Pin 77*a* locks handle 28 from moving when 28 is in the switch closed position as shown in FIG. 1, while pin 77*b* actuates the solenoid to the de-energization state. This allows a motor operation for test purpose if desired, without operating switch 10. This can be a great convenience in contrast to prior operators that require either testing the motor with the switch being driven or more inconvenient measures taken to disconnect the motor.

FIGS. 6, 7, 8 and 9 show isometric views of different stages in the operation of the example drive assembly 42 as seen as a "birds eye view" of FIG. 3. FIGS. 6 through 9 also show the operator shaft 30, the position of the output lever 26, and the position of the solenoid assembly 73 fixed to the first drive plate 44 and position of pin 52.

Figure 6:
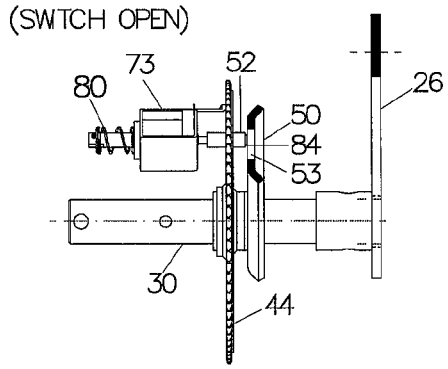
FIGS. 6, 7, 8 and 9 are elevation views of part of the drive assembly of the motor operator of FIGS. 3-5 at successive stages of operation.

In FIG. 6, the orientation of the elements is for a fully open switch 10 position with the lever 26 straight up as shown in FIG. 3 and viewed from above the mechanism. At this position the motor 36 and solenoid 73 have not been energized, therefore pin 52 is not engaged with drive plate 50, but is aligned with slot 53.

Figure 7:
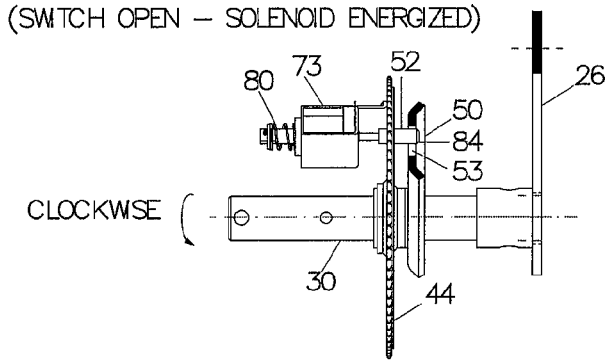

FIG. 7 shows the position when the solenoid has been energized and pin 52 has engaged drive plate 50 via slot 53, thereby lever 26 will start to rotate clockwise toward the switch closed position via the motor.

Figure 8:
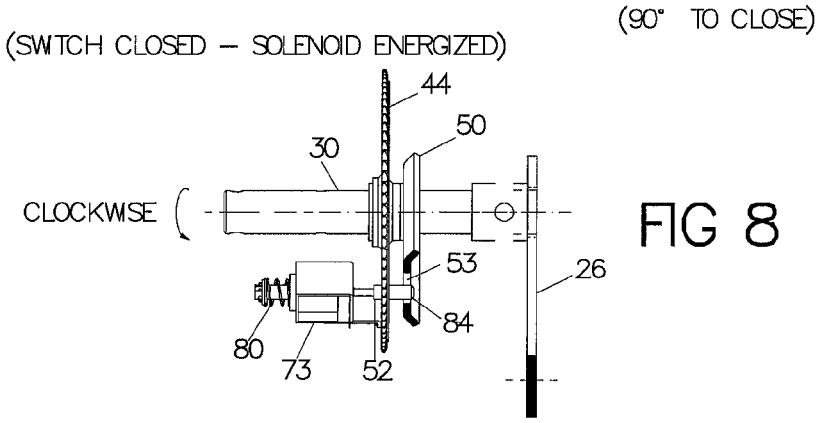

FIG. 8 shows that the lever 26 has rotated clockwise 90° to the closed position of switch 10 because the motor driving plate 44 was coupled to plate 50 via the solenoid pin 52.

Figure 9:
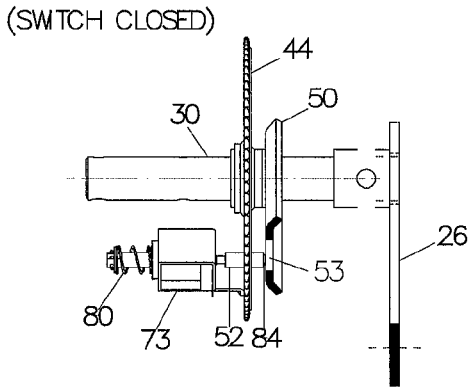

FIG. 9 also shows the switch 10 in the closed position after the motor and solenoid have been de-energized which causes the pin 52 to disengage with plate 50 due to the solenoid return spring 80. This allows the switch 10 to be manually operated via the handle 28.

Figure 10:
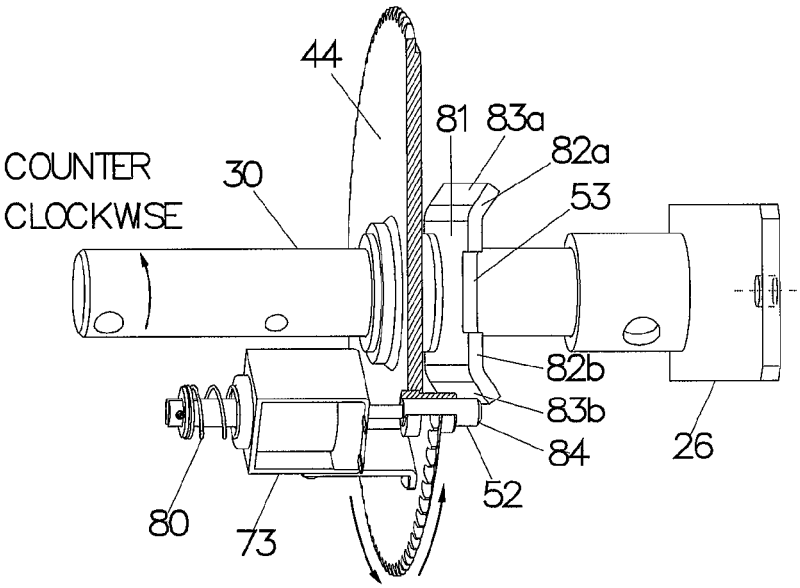
FIG. 10 is a perspective view of part of the drive assembly of the motor operator, showing a first drive plate, partially broken away riding on a bearing but not coupled to the output shaft and a second drive plate coupled to the output shaft, and showing the solenoid assembly fixed to the first drive plate with the spring-loaded solenoid pin contacting a cam surface of the second drive plate just prior to entering the slot in the second drive plate; and, FIG. 11 is a perspective view of part of the drive assembly of the motor operator showing the second drive plate coupled to the output shaft with the spring-loaded solenoid pin engaging the slot in the plate.
Figure 11:
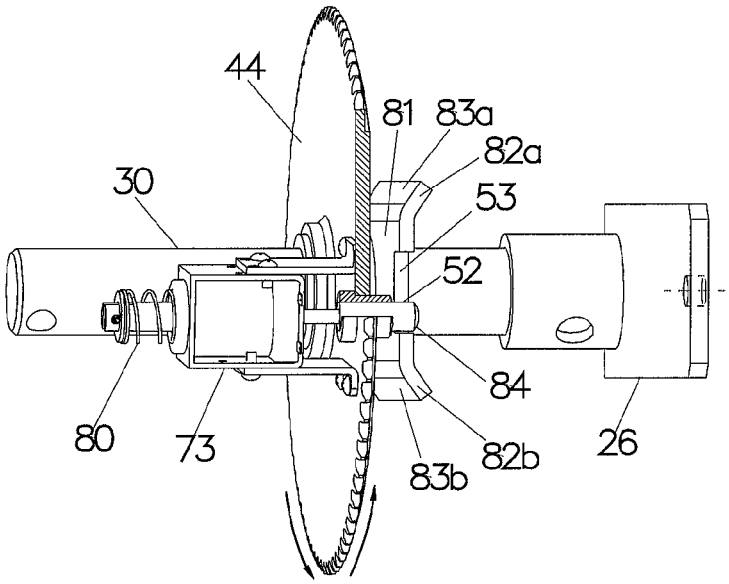

Now, if switch 10 were to be manually operated via handle 28 from the closed position shown in FIGS. 1 and 8 to the open position shown in FIGS. 2 and 10, plate 50 would be rotated counterclockwise and pin 52 has not moved. Then if the motor were to be also operated to make plate 44 rotate counterclockwise, this would cause pin 52 to instantly extend out as the motor was energized and pin 52 would contact the cam surface 83*b* of plate 50 and re-engage into the slot 53 in plate 50 as shown with reference to FIGS. 6 and 10. The plate 50 is provided with the two cam surfaces 83*a*, 83*b* to accommodate a re-synchronizing operation after a manual operation due to the motion of plate 44 being clockwise or counterclockwise. Within the broad fields of mechanical power transmissions and mechanical linkages are a wide variety of known mechanisms that may be adapted for the purposes of a motor operator in accordance with the invention. Applicant's invention resides principally in novel combinations of such mechanisms with other motor operator elements.

The plate 50, as shown in FIGS. 6-11, viewed from an end of plate 50 preferably may have a substantially flat central area 81 with two angled wing portions 82*a*, 82*b* extending from either side thereof (angled away from plate 44) carrying the cam surfaces 83*a*, 83*b* for contacting pin 52. The angle of the wing portions 82*a*, 82*b* may be such as about 30° from the central flat area 81. Preferably pin 52 is provided with a chamfer on the end 84 thereof which may be, for example, about a 30° chamfer with respect to the axis of pin 52. The chamfered end 84 contacts cam surface 83*a*, 83*b* which provides smooth transition for the pin 52 as it is moved towards the slot 53 in the plate 50 situated between the wing portions 82*a*, 82*b*. In the regard to the pin 52 during energization of solenoid 73, the pin 52 passes by cam surface 83*b* and flat surface 81 to re-engage slot 53 to ensure that the motor is coupled to the output member 26. During the camming of the pin, the camming force is greater than the solenoid force which allows the pin to move to the left, then move right to enter the slot 53. Of course, it is possible as an aspect of this invention, that only the wing portions 82*a*, 82*b* are provided with a cam surface or surfaces, or that only the pin 52 is provided with a chamfer.

From the above description, it can be understood a motor operator is provided with a drive assembly 42 with a unique transducer that moves as plate 44 moves including, at least in part, means for transmitting switch operating force from the motor 36 to the output member 26 that results in a decoupled state of the motor and the output member, even absent any reversal of the motor (e.g., either automatically by an electrical controls system or manually initiated) and before any manual operation is performed. The means for transmitting the force can include, at least in part, the first drive plate 44 with solenoid assembly 73 attached and a second drive plate 50 including a slot 53 that are rotatable. The means for transmitting the force also includes temporary engagement of pin 52 of solenoid assembly 73 fixed to the drive plate 44 engaging plate 50 at slot 53 such as described in connection with FIGS. 6-11.

In various parts of the description and claims where parts of elements or combinations of elements are described, none of the descriptions are to be taken as implying restriction to only the named elements when such a restriction is not required by other language. Accordingly, terms such as "having", "including" or "comprising" are generally to be taken as intended to be open to other aspects or elements (whether or not spelled out) unless otherwise stated to be limited. While the invention requires only fairly simple mechanical elements, one could accompany them with various aspects of automated control if desired. Consequently, it is apparent numerous variations in accordance with the general teachings given above are suitable for practice of the invention such as putting the camming and slot elements on plate 44 and the solenoid on plate 50, as previously mentioned.

What is claimed is:

1. A motor operator, for an electrical power switch, comprising:

a motor having a motor shaft;

an output member attachable to a switch operating mechanism;

an electromechanical drive assembly coupled between the motor shaft and the output member, the electromechanical drive assembly including a first drive element continuously mechanically linked to, and subject to movement with, the motor shaft and a second drive element continuously mechanically linked with the output member;

the first drive element having affixed thereto an electromechanical transducer including a movable part upon energization of the transducer, the movable part arranged on the first drive element to temporarily mechanically engage the second drive element, with transfer of motor force to the output member sufficient for the operation of the electrical power switch, during operation of the motor;

the first and second drive elements and their temporary engagement of the movable part with the second drive element also being arranged to disengage from each other following motor operation and de-energization of the electromechanical transducer and retraction of the movable part from engagement with the second drive element to effect positive disengagement of the first and second drive elements;

an operating member continuously mechanically linked with the output member, the operating member being arranged to receive manual force from a source independent of the motor to drive the output member without requiring movement of the motor shaft or the first drive element.

2. The motor operator of claim 1 where:

the operating member at least in part includes a handle secured with a shaft fixed with the output member with one or more features for temporary location of a hand tool for manual operation of the output member while the first and second drive elements are disengaged.

3. The motor operator of claim 2 where:

the operating member and a stationary part of the motor operator are arranged to be manually lockable together to allow power operation of the motor without movement of the output member.

4. The motor operator of claim 1 where:

the first drive element includes a first drive plate rotatable on a bearing about a first shaft portion and mechanically linked to rotate in direct relation to rotation of the motor shaft and having the transducer affixed thereto with the movable part extending therefrom;

the second drive element includes a second drive plate on a second shaft portion mechanically linked to the output member and the second drive plate having an opening in the periphery thereof or including a catch element including a cam surface attached to the periphery thereof for engaging the movable part upon energization of the transducer.

5. The motor operator of claim 4 where:

the operating member is arranged to hit a positive mechanical stop, after motor operation has resulted in sufficient force transfer to the output member, that also stops movement of the second drive plate.

6. The motor operator of claim 4 where:

the first and second shaft portions are coaxial; the first drive plate is chain driven off of the motor shaft and runs freely in relation to the first shaft portion; and the second drive plate is fixed to the second shaft portion.

7. The motor operator of claim 4, wherein the transducer comprises a solenoid assembly including a movable spring-loaded pin.

8. The motor operator of claim 7, wherein the second drive plate is radially arranged with respect to the second shaft portion.

9. The motor operator of claim 8, wherein the second drive plate includes at least one cam surface on one side thereof for contacting the movable pin.

10. The motor operator of claim 8, where the second drive plate has a flat rectangular central portion arranged between two opposite wing portions, each of the wing portions extending from the flat central portion at a predetermined angle.

11. The motor operator of claim 8, wherein each of the wing portions has at least one cam surface arranged on the side of the second drive plate proximate the movable pin for contact with the movable pin upon energization and sufficient rotation of the first drive plate.

12. The motor operator of claim 10, wherein the opening is arranged in the periphery of the flat central portion.

13. The motor operator of claim 7, wherein the movable spring-loaded pin has a chamfered end for contacting the second drive plate.

14. The motor operator of claim 7, further comprising a lockout device including a lockout switch for preventing any energization of the solenoid assembly to allow power operation of the motor without movement of the output member.

15. The motor operator of claim 14, wherein the lockout switch further includes a second spring-loaded pin for activation of the lockout switch.

16. The motor operator of claim 15, wherein the lockout device further includes a manually movable frame member including a contact pin in alignment with the second spring-loaded pin for contacting the second spring-loaded pin to activate the lockout switch and prevent energization of the solenoid.

17. An electrical power switch and a motor operator in combination, comprising:

a mechanical actuating linkage between the motor operator and the electrical power switch;

an output member attachable to a switch operating mechanism;

an electromechanical drive assembly coupled between the motor shaft and the output member, the electromechanical drive assembly including a first drive element continuously mechanically linked to, and subject to movement with, the motor shaft and a second drive element continuously mechanically linked with the output member;

the first drive element having affixed thereto an electromechanical transducer including a movable part upon energization of the transducer, the movable part arranged on the first drive element to temporarily mechanically engage the second drive element, with transfer of motor force to the output member sufficient for the operation of the electrical power switch, during operation of the motor;

the first and second drive elements and their temporary engagement of the movable part with the second drive element also being arranged to disengage from each other following motor operation and de-energization of the electromechanical transducer and retraction of the movable part from engagement with the second drive element to effect positive disengagement of the first and second drive elements;

a manual operating member continuously linked with the mechanical actuating linkage and arranged to be accessible for manually operating the switch from ground level without turning the motor; and the manual operating member and a stationary part of the motor operator being accessible for manually locking together to allow power operation of the motor without movement of the mechanical actuating linkage.

18. The combination of claim 17 wherein:

the first drive element includes a first drive plate rotatable on a bearing about a first shaft portion and mechanically linked to rotate in direct relation to rotation of the motor shaft and having the transducer affixed thereto with the movable part extending therefrom;

the second drive element includes a second drive plate on a second shaft portion mechanically linked to the output member and the second drive plate having an opening in the periphery thereof or including a catch element including a cam surface attached to the periphery thereof for engaging the movable part upon energization of the transducer.

19. The combination of claim 18, wherein the transducer comprises a solenoid assembly including a movable spring-loaded pin.

20. The combination of claim 19, wherein the second drive plate is radially arranged with respect to the second shaft portion.

21. The combination of claim 20, wherein the second drive plate has at least one cam surface on one side thereof for contacting the movable pin.

22. The combination of claim 21, wherein the second drive plate has a flat rectangular central portion arranged between two opposite wing portions, each of the wing portions extending from the flat central portion at a predetermined angle.

23. The combination of claim 22, wherein each of the wing portions have at least one cam surface arranged on the side of the second drive plate proximate the movable pin member for contact with the pin upon energization and sufficient rotation of the first drive plate.

24. The combination of claim 19, further comprising a lockout device including a lockout switch for preventing any energization of the solenoid assembly to allow power operation of the motor without movement of the output member.

25. The combination of claim 24, wherein the lockout switch further includes a second spring-loaded pin for activation of the lockout switch.

26. The combination of claim 25, wherein the lockout device further includes a manually movable frame member including a contact pin in alignment with the second spring-loaded pin for contacting the second spring-loaded pin to activate the lockout switch and prevent energization of the solenoid.

27. The combination of claim 19, wherein the movable spring-loaded pin has a chamfered end for contacting the second drive plate.

28. An overhead electrical power switch and a motor operator in a combination installed together at an elevated location and comprising:

a mechanical actuating linkage between the motor operator and one or more movable contacts of the switch at the elevated location;

the motor operator including a motor, an output member joined with the mechanical actuating linkage, a drive assembly between the motor and the output member, and an operating member that extends to an exteriorly accessible position of the motor operator;

the motor is one capable of being reversibly driven to operate the switch, through the drive assembly, the output member and the mechanical actuating linkage, from a closed position to an open position and from an open position to a closed position;

the output member and the operating member being in a fixed relation for movement together;

an electro-mechanical drive assembly coupled between the motor shaft and the output member, the electromechanical drive assembly including a first drive element continuously mechanically linked to, and subject to movement with, the motor shaft and a second drive element continuously mechanically linked with the output member;

the first drive element having affixed thereto an electromechanical transducer including a movable part upon energization of the transducer, the movable part arranged on the first drive element to temporarily mechanically engage the second drive element, with transfer of motor force to the output member sufficient for electrical power switch operation, during operation of the motor;

the first and second drive elements and their temporary engagement of the movable part with the second drive element also being arranged to disengage from each other following motor operation and de-energization of the electromechanical transducer and retraction of the movable part from engagement with the second drive element to effect positive disengagement of the first and second drive elements the drive assembly including, at least in part, means for transmitting switch operating force from the motor to the output member that results in a decoupled state of the motor and the output member following each switch operation, even absent any reversal of the motor and before any manual operation; and, the operating member comprises means for cooperating with an operating force means independent of the motor of the motor operator to operate the switch through the output member without operation of the motor of the motor operator.

29. The combination of claim 28 wherein:

the first drive element includes a first drive plate rotatable on a bearing about a first shaft portion and mechanically linked to rotate in direct relation to rotation of the motor shaft and having the transducer affixed thereto with the movable part extending therefrom;

the second drive element includes a second drive plate on a second shaft portion mechanically linked to the output member and the second drive plate having an opening in the periphery thereof or including a catch element including a cam surface attached to the periphery for engaging the movable part upon energization of the transducer.

30. The combination of claim 29, wherein the transducer comprises a solenoid assembly including a movable spring-loaded pin.

31. The combination of claim 30, wherein the second drive plate is radially arranged with respect to the second shaft portion.

32. The combination of claim 31, wherein the second drive plate has at least one cam surface on one side thereof for contacting the movable pin.

33. The motor operator of claim 31, where the second drive plate has a flat rectangular central portion arranged between two opposite wing portions, each of the wing portions extending from the flat central portion at a predetermined angle.

34. The combination of claim 33, wherein each of the wing portions have at least one cam surface arranged on the side of the second drive plate proximate the movable pin for contact with the pin upon energization and sufficient rotation of the first drive plate.

35. The combination of claim 30, further comprising a lockout device including a lockout switch for preventing any energization of the solenoid assembly to allow power operation of the motor without movement of the output member.

36. The combination of claim 35, wherein the lockout switch further includes a second spring-loaded pin for activation of the lockout switch.

37. The combination of claim 34, wherein the lockout device further includes a manually movable frame member including a contact pin in alignment with the second spring-loaded pin for contacting the second spring-loaded pin to activate the lockout switch and prevent energization of the solenoid.

38. The combination of claim 30, wherein the movable spring-loaded pin has a chamfered end for contacting the second drive plate.

* * * * *